US006943319B2

(12) United States Patent
Jones

(10) Patent No.: US 6,943,319 B2
(45) Date of Patent: Sep. 13, 2005

(54) TRIAXIAL HEATING CABLE SYSTEM

(75) Inventor: Thaddeus M. Jones, Bremen, IN (US)

(73) Assignee: MSX, Inc, South Bend, IN (US)

( * ) Notice: Subject to any disclaimer, the term of this patent is extended or adjusted under 35 U.S.C. 154(b) by 0 days.

(21) Appl. No.: 10/706,005

(22) Filed: Nov. 12, 2003

(65) Prior Publication Data

US 2005/0109753 A1 May 26, 2005

(51) Int. Cl.[7] ..... H05B 3/36

(52) U.S. Cl. ..... 219/213; 219/212; 219/202; 219/203; 219/217; 219/218; 219/219; 174/102; 174/103; 174/104; 174/106; 174/113

(58) Field of Search ..... 219/213, 217, 219/218, 219, 203, 202, 212; 174/103, 104, 174/106, 107, 102, 113, 120, 75 C, 20, 25 C; 29/858, 872, 825

(56) References Cited

U.S. PATENT DOCUMENTS

| | | | | |
|---|---|---|---|---|
| 3,180,926 | A | 4/1965 | Trill | 174/107 |
| 3,896,261 | A | 7/1975 | Cole | 174/115 |
| 4,376,920 | A | 3/1983 | Smith | 333/12 |
| 4,408,089 | A | 10/1983 | Nixon | 174/34 |
| 4,617,449 | A | 10/1986 | Weitzel et al. | 219/301 |
| 4,626,810 | A | 12/1986 | Nixon | 333/243 |
| 4,642,417 | A | 2/1987 | Ruthrof et al. | 174/36 |
| 5,015,800 | A | 5/1991 | Vaupotic et al. | 174/34 |
| 5,132,491 | A | 7/1992 | Mulrooney et al. | 174/36 |
| 5,418,332 | A | 5/1995 | Moncrieff | 174/115 |
| 5,935,470 | A * | 8/1999 | Deo et al. | 219/463.1 |
| 6,291,773 | B1 | 9/2001 | Nikkels et al. | 174/120 |
| 6,293,005 | B1 | 9/2001 | Van Den Berg et al. | 29/828 |
| 6,703,593 | B2 * | 3/2004 | Sopory | 219/505 |

* cited by examiner

*Primary Examiner*—Shawntina Fuqua
(74) *Attorney, Agent, or Firm*—Taylor & Aust, P.C.

(57) ABSTRACT

A cut-to-length heating system including a heating cable having a first conductor with a first resistivity and a second conductor with a second resistivity. The heating cable having a first end and a second end with the first conductor being electrically connected to the second conductor at the first end. The first resistivity substantially higher than the second resistivity. An average power limiting device electrically connecting the first conductor and the second conductor at the second end.

17 Claims, 6 Drawing Sheets

TRIAXIAL HEATING CABLE SYSTEM

BACKGROUND OF THE INVENTION

1. Field of the Invention

The present invention relates to a triaxial heating cable, and, more particularly, to a triaxial heating cable system with a power controller.

2. Description of the Related Art

The conversion of electrical energy into heat has been utilized for a significant period of time. The direct conversion of electrical energy to heat was first described by English physicist James P. Joule. According to Joule's law, a conductor carrying a current generates heat at a rate proportional to the product of the resistance of the conductor and the square of the current. It is the use of this principal, of applying electrical energy to a distributed resistance, which provides heat to an area or volume that is in thermal contact with the distributed resistance. Distributed resistance electrical heaters are utilized in providing heat to surfaces such as walkways or pavement, thereby removing snow and ice.

Now referring to FIGS. 1–3 there is illustrated cross-sectional views of distributed resistive elements. In FIG. 1 there is shown a mineral insulated heating cable 10 including heater wires 12, insulation 14 and metallic sheath 16. Heater wires 12 traverse the length of heating cable 10 and are electrically resistive in nature. Insulation 14 is a mineral type insulation capable of withstanding significant temperatures and conducting heat from heater wires 12 to metallic sheath 16. Heat that originates with heater wires 12 is additionally passed through metallic sheath 16 to thereby heat any item in contact with metallic sheath 16. Resistive wires 12 are terminated at a distal end of the cable to thereby provide a completed electrical circuit to another end of heating cable 10.

In FIG. 2 there is shown a self limiting heating cable 20 including a first bus wire 22, a second bus wire 24, conductive polymer 26 and insulation/shield 28. The shape of self limiting heating cable 20 is often elliptical in nature in order to conduct and dissipate heat produced between bus wires 22 and 24. Bus wires 22 and 24 are conductive wires with relatively low resistance as compared to wires 12 of heating cable 10. Bus wires 22 and 24 provide an electrical potential difference therebetween that is conducted through conductive polymer 26. Heat thus generated is then thermally conducted in and through conductive polymer 26 and through insulation shield 28 to an item that is in contact with self-limiting heating cable 20. Conductive polymer 26 is typically a positive temperature coefficient material, which increases in resistance with the rise of temperature thereby self-limiting the temperature of heating cable 20.

Mineral insulated heating cable 30 is similar to cable 10 except that it has only one heater wire 32 surrounded by insulation 34 and metallic sheath 36. One end of heater wire 32 is connected with a source and another end of heater wire 32 is connected to a return line (not shown). A single conductor cable such as heating cable 30 requires that both ends be electrically connected in order to provide a circuit therethrough.

A problem with heating cables 10 and 30 are that the heat is generated in and at the surface of heater wires 12 and 32 thereby causing a high temperature area to exist in the center of cable 10 and 30 respectively. The high temperature area must be accommodated by an electrical insulating material that can efficiently remove the heat generated at resistive wires 12 and 32. The problem with self-limiting heating cable 20 is that the heat is mainly generated between bus wires 22 and 24 and not uniformly in conductive polymer 26. This is somewhat compensated for by an elliptical shape of such a cable to reduce the distance from the area in which heat is generated to an exterior surface of heating cable 20, but the shape requires a large radius to bend it about the major axis. Additionally, self-limiting heating cable 20 is typically very stiff and resists bending, thus making installation difficult.

The use of cable 10 requires a matching of the length of the cable with the resistivity of wires 12 to the potential power source to be applied to optimize the heat generated within cable 10. Cable 20 may be cut to any length and rely upon the self-limiting feature to prevent an overheating condition for cable 20. Cable 30 in addition to the disadvantages of cable 10 requires that both ends be terminated most likely away from the object being heated, thereby requiring access to each end of cable 30.

What is needed in the art is a heater cable that can be cut to length, be easy to install and provide an efficient heat distribution feature.

SUMMARY OF THE INVENTION

The present invention provides a triaxial heater cable system with an overheating prevention system to prevent the destruction of the heater cable.

The invention comprises, in one form thereof, a cut-to-length heating system including a heating cable having a first conductor with a first resistivity and a second conductor with a second resistivity. The heating cable having a first end and a second end with the first conductor being electrically connected to the second conductor at the first end. The first resistivity substantially higher than the second resistivity. An average power limiting device electrically connecting the first conductor and the second conductor at the second end.

An advantage of the present invention is that heat is more effectively distributed from the heater cable.

Another advantage is that the heater cable can be cut to length and terminated.

Yet another advantage is that the electrical fields created by alternating current are effectively cancelled resulting in a very low electromagnetic field radiation.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
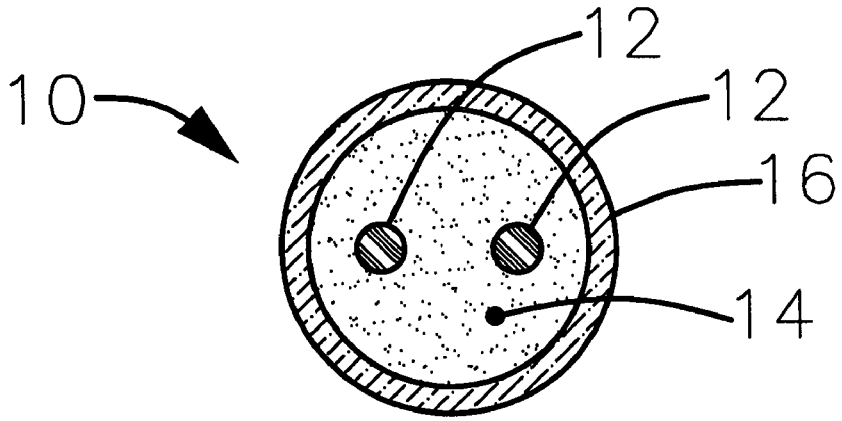
Prior Art Fig.1
FIG. 1 schematically illustrates a cross-sectional area of a prior art heating cable.
Figure 2:
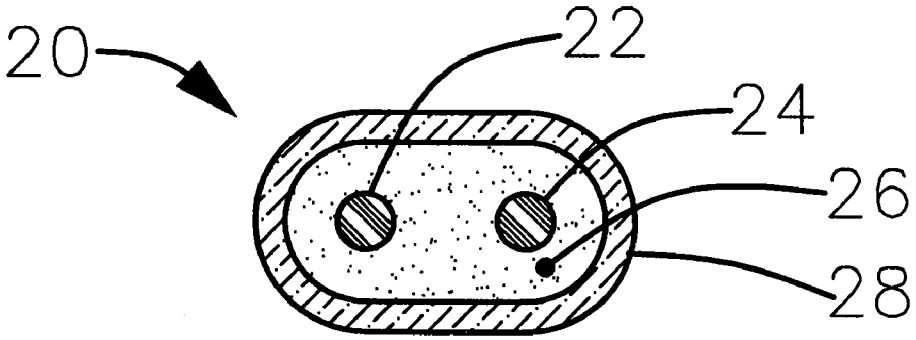
Prior Art Fig.2
FIG. 2 schematically illustrates a cross-section of another prior art heating cable.
Figure 3:
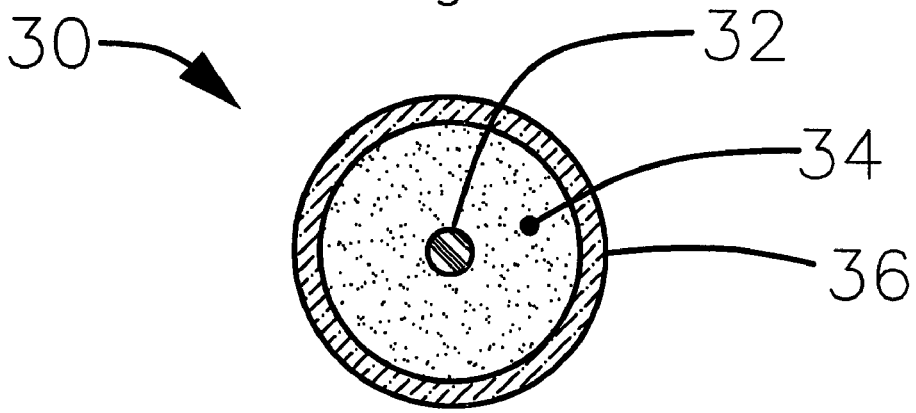
Prior Art Fig.3
FIG. 3 schematically illustrates a cross-sectional view of yet another prior art heating cable.
Figure 4:
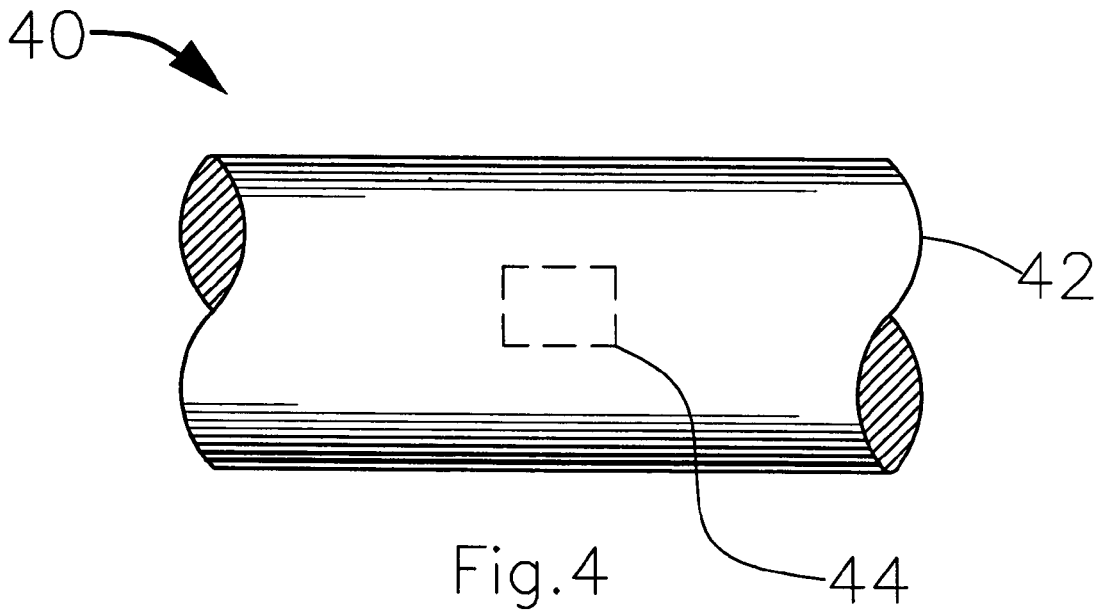
FIG. 4 illustrates a resistive wire for discussion purposes of the present invention.
Figure 5:
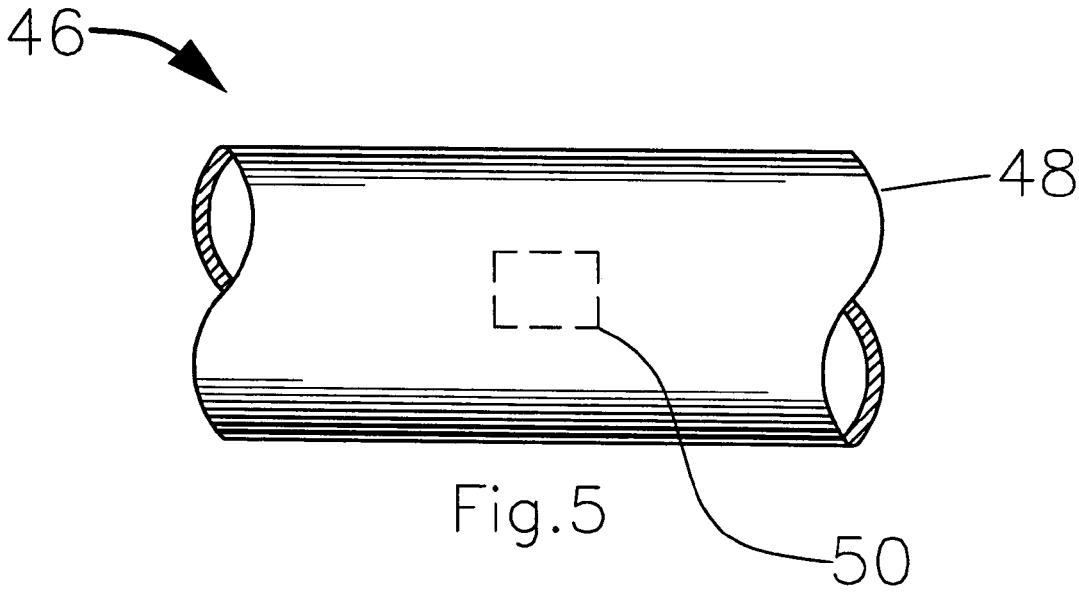
FIG. 5 illustrates a resistive shell utilized in the present invention.

Referring now to the drawings, and more particularly to FIGS. 4 and 5, there is illustrated an important aspect of the present invention. Wire 40 includes surface 42 and an illustrative unit area 44. Resistive shell 46 includes surface 48 and a representative unit area 50. The diameter of wire 40 is significantly smaller than the diameter of resistive shell 46. A typical wire 40 in a heater application consists of a 30 gauge copper wire having a diameter of approximately 0.010 inches and a resistance of 104 ohms per one thousand feet. When used in a floor warming application, a typical heater wire operates at approximately 2 Watts per foot. The surface area of a 1 foot length of wire 40 is approximately 0.002618 square feet. The application of 2 Watts of power per linear foot of wire 40 yields a power flux of approximately 764 Watts per square foot. Unit area 44 of surface 42 would produce heat at the rate of 764 Watts per square foot in order to provide the 2 Watts per foot needed. The power flux is the key parameter since it determines the temperature of the interface between the heater wire and a surrounding insulation. In contrast, resistive shell 46 is significantly larger than wire 40. For example, it is reasonable to assume that resistive shell 46 would be approximately 0.10 inches in diameter, which would result in a surface area of resistive shell 46 of approximately 0.02618 square feet per foot of length. In order to product 2 Watts per foot the power flux of resistive shell 46 would be approximately 76 Watts per square foot. Even if resistive shell 46 is a braided wire with only approximately 85% coverage, the resultant power flux density is approximately 90 Watts per square foot. As such, the power flux at a unit area 50 is an order of magnitude less than the power flux density of wire 40. As such, resistive shell 46 is capable of producing a substantially greater amount of heat without exceeding the temperature rating of insulation proximate to resistive shell 46.

Figure 6:
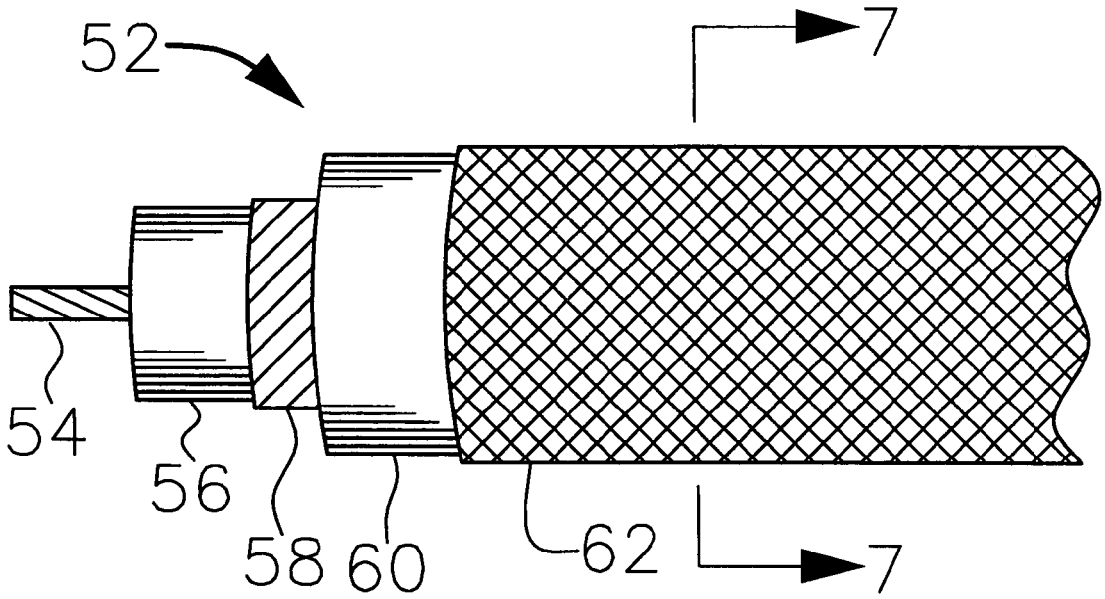
FIG. 6 illustrates a triaxial heating cable of the present invention with the resistive shell of FIG. 5.
Figure 7:
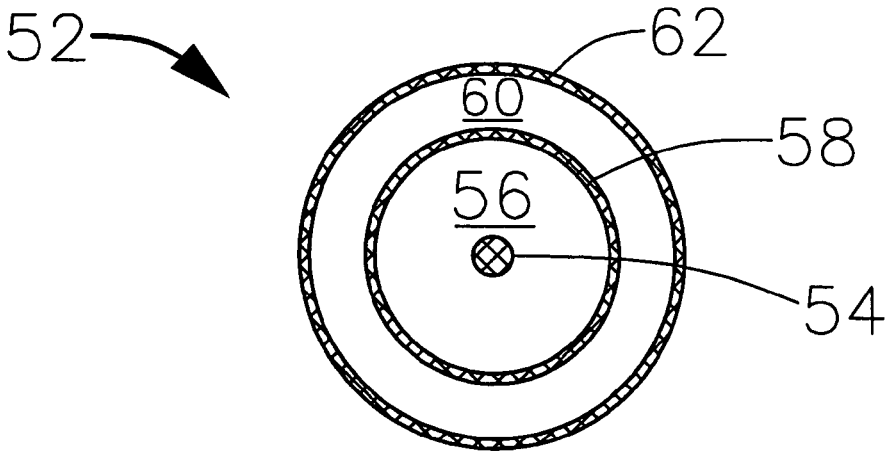
FIG. 7 illustrates a cross-sectional view of the triaxial heating cable of FIG. 6.

Now, additionally referring to FIGS. 6 and 7, there is illustrated a triaxial heater cable 52 including a central conductor 54, an insulation layer 56, a resistive shell 58, an insulation layer 60 and a safety shell 62. Cable 52 can be used to heat a walkway, a paved area, a gutter, a roof or other surface for the removal of snow/ice therefrom. Central conductor 54 has a high conductivity and is surrounded by insulation 56.

Insulation 56 is an electrically and thermally insulative layer on which resistive shell 58 is positioned against. Resistive shell 58 is substantially similar to resistive shell 56 previously discussed. Resistive shell 58 may be a pattern of resistive wires wound or woven around insulation 56, such as in a mesh or helical winding. The resistivity of resistive shell 58 is several times higher than the resistivity of central conductor 54; the purpose of such is for the generation of heat to occur in resistive shell 58 rather than in central conductor 54. The resistance of resistive shell 58 may be several times and preferably at least 10 times higher than the resistance of central conductor 54. It should be understood that a reference to the resistance of resistive shell 58 is an equivalent resistance, for example, if resistive shell 58 is made up of numerous individual fine resistive wires it is the equivalent resistance of the resistive wires that amounts to the total resistance of resistive shell 58.

Insulation 60 covers resistive shell 58 and provides an electrical isolation of resistive shell 58. Insulation 60 is composed of a thermally conductive insulation to thereby pass heat generated by resistive shell 58 through insulation 60. Surrounding insulation 60 is safety shield 62, which may be a corrosive resistant metal braid to provide mechanical and electrical safety characteristics to triaxial cable 52. As can be seen in FIG. 7, the relative cross-sectional diameter of central conductor 54 is considerably smaller than the diameter of resistive shell 58, which lends itself to the advantages previously discussed of utilizing resistive shell 58 as the heat producing component of triaxial cable 52.

Figure 8:
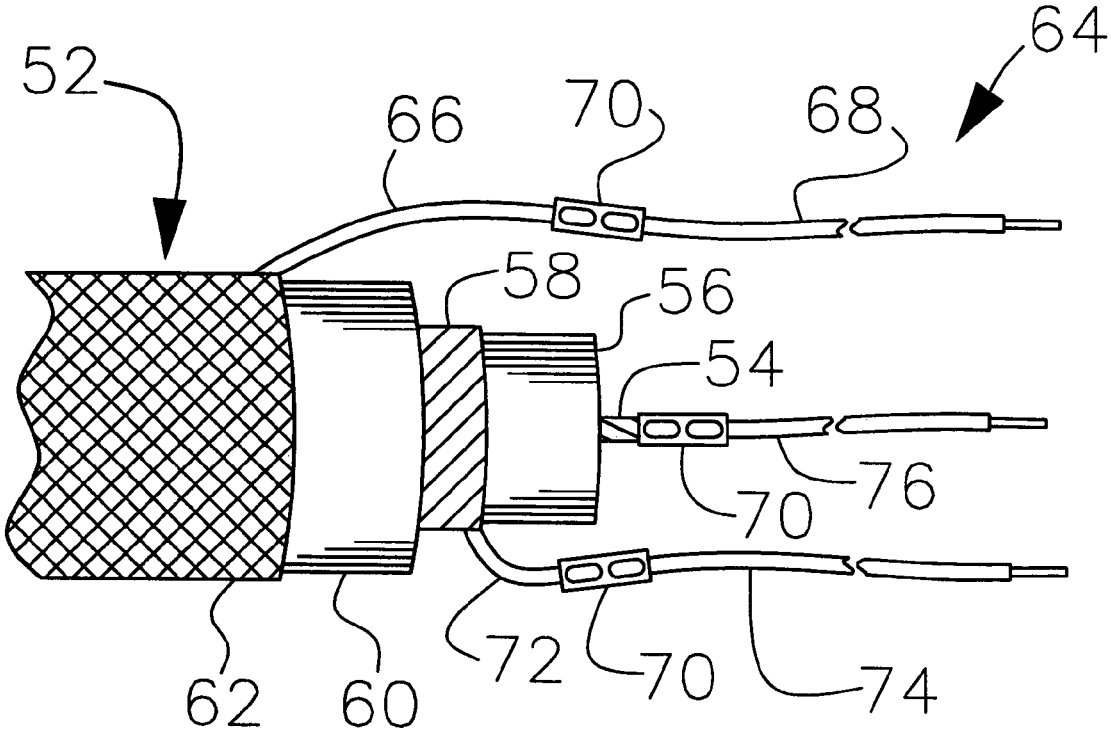
FIG. 8 illustrates the termination of one end of the heating cable of FIGS. 6 and 7.
Figure 9:
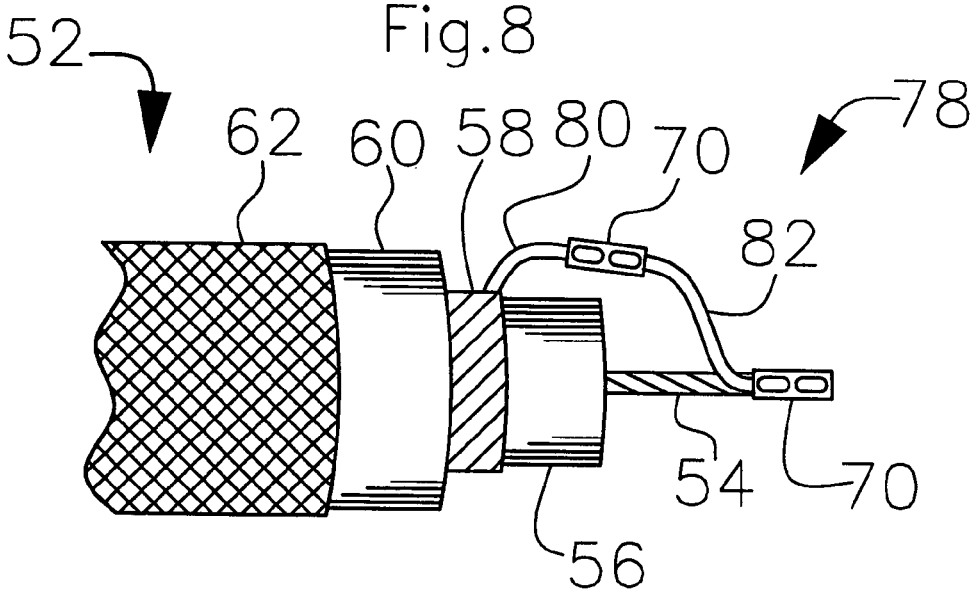
FIG. 9 illustrates the termination of another end of the heating cable of FIGS. 6 and 7.

Now, additionally referring to FIGS. 8 and 9, there is illustrated supply-end termination 64 and cut-end termination 78. Supply end termination 64 includes a shield link 66, lead wire 68, crimp connectors 70, shell link 72 and lead wires 74 and 76. Supply end termination 64 is utilized to interconnect with power and control sources to provide power electrical connections to lead wires 74 and 76 and a safety ground to lead wire 68. Shield link 66 may be interconnected with shield 62 to provide an electrical grounding connection therefrom. Alternatively, shield link 66 may be a gathering of unwoven portions of shield 62. Shield link 66 is electrically and mechanically bonded with lead wire 68 by a crimp connector 70. Crimp connectors 70 are utilized to provide electrical connections to triaxial cable 52 to accommodate the heat that may be produced at such an interconnection.

Shield link 72 may be a separate wire or a gathering of individual wires from resistive shell 58. Alternatively, shell link 72 may be a separate conductor that runs along at least a portion of resistive shell 58 and is electrically connected thereto. A crimp connector 70 is utilized to connect shell link 72 to lead wire 74. Central conductor 54 is electrically connected to lead wire 76 by way of another crimp connector 70.

One advantage of triaxial cable 52 and the control assemblies associated therewith is that the length of triaxial cable 52 can be decided at the point of installation, cut to length, and then terminated as shown in FIG. 9. Cut-end terminations 78 include shell link 80 and lead wire 82. Shell link 80 is substantially similar to shell link 72 in that it electrically connects resistive shell 58 to lead wire 82. Alternatively shell link 80 may be directly crimped to central conductor 74 without the use of a lead wire 82. An advantage of using lead wire 82 is that lead wire 82 is highly conductive compared to resistive shell 58 to thereby prevent or minimize the formation of a thermal hot spot. Although not shown, cut-end terminations 78 are covered with an insulation material and a waterproof covering.

Since the resistance per linear foot of triaxial cable 52 is relatively constant, the cutting of triaxial cable 52 and applying cut-end termination 78 thereto alters the overall resistance of resistive shell 58 by the shortening thereof. The shortening of triaxial cable 52 lowers the resistance of resistive shell 58 based upon the remaining length of triaxial cable 52. As such, a compensation for the changed resistance of triaxial cable 52 is also undertaken by the present invention. One embodiment of the present invention involves a monitoring of the temperature of triaxial cable 52 and then modulating the power thereto to prevent overheating of triaxial cable 52. Another embodiment of the present invention includes a method of controlling the heat dissipated in triaxial cable 52 by ascertaining the resistance of triaxial cable 52 and then adjusting the power density supplied to cable 52 to limit the heat created therein. Yet another method involves limiting the current to cable 52 so that the heat per unit length is a constant no matter how short cable 52 is cut and terminated. These approaches advantageously keep the heat produced per unit length constant regardless of the length of cable 52.

Figure 10:
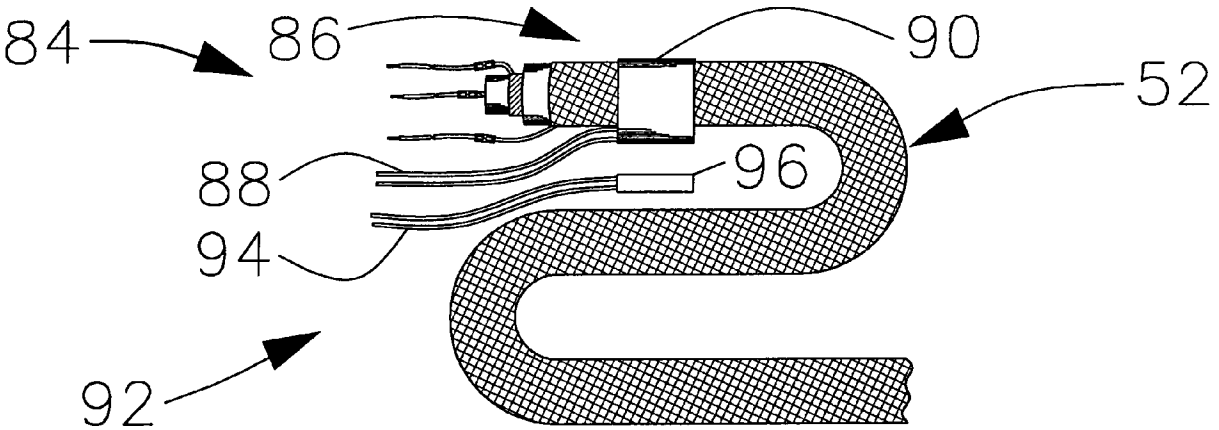
FIG. 10 illustrates a heating cable assembly utilizing the triaxial heating cable of FIGS. 6–9.
Figure 11:
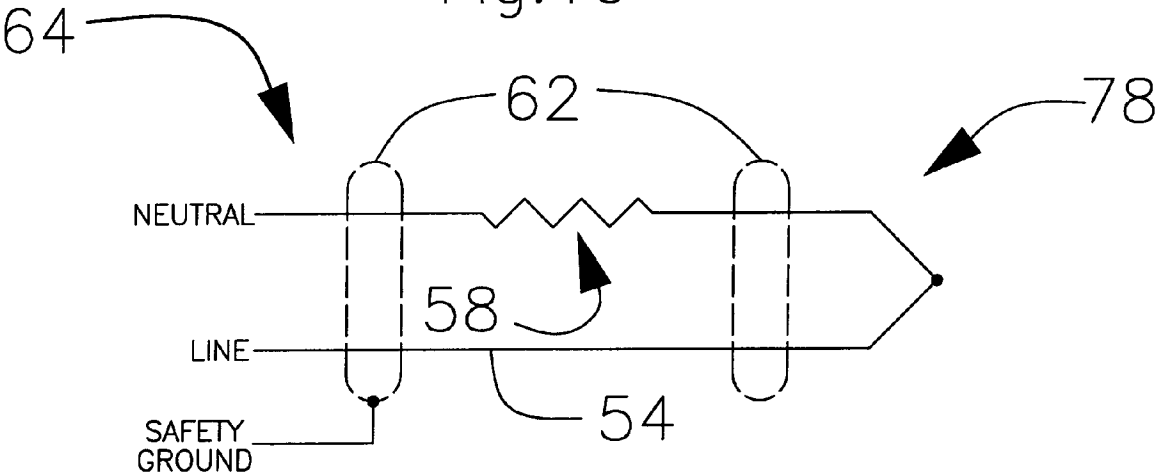
FIG. 11 schematically illustrates the electrical elements of the triaxial heating cable of FIGS. 6–10.
Figure 12:
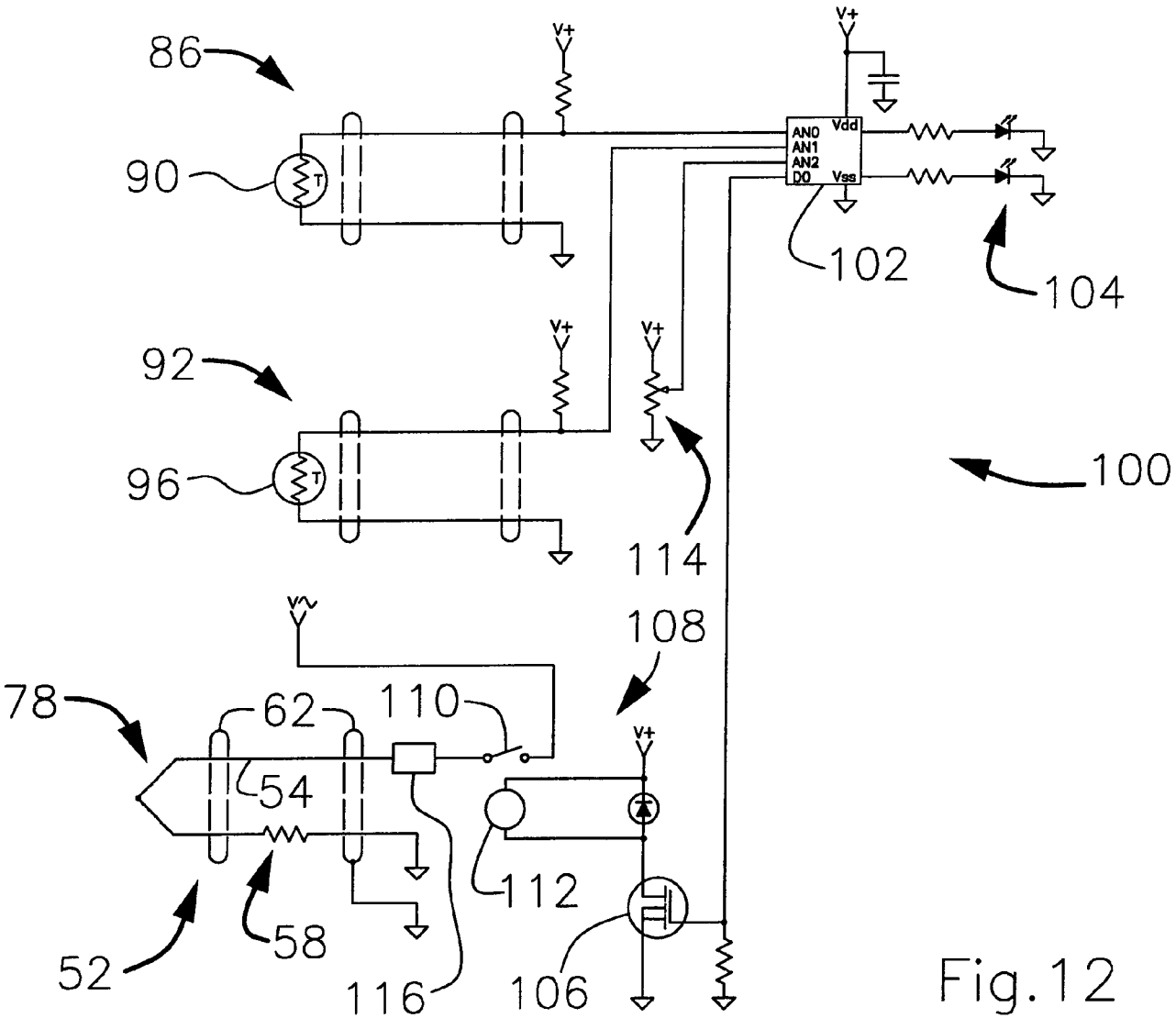
FIG. 12 is a schematic illustration of electrical interconnections of the triaxial heater cable system.

Now, additionally referring to FIGS. 10 and 11, there is illustrated a heater assembly 84 including thermal sensor assemblies 86 and 92. Thermal sensor assembly 86 includes sensor wires 88 and intimate thermal sensor 90. Sensor wires 88 go to a control system as depicted in FIG. 12 for control of heater assembly 84. Intimate thermal sensor 90 is in close proximity, attached to, or embedded within a portion of triaxial cable 52 to detect the temperature of cable 52 as heat is generated therein. Since cable 52 has a small amount of mass the heat buildup will rapidly be conducted to a portion of intimate thermal sensor 90 in such a manner that thermal sensor 90 closely tracks the temperature of cable 52. Thermal sensor assembly 92 includes sensor wires 94 and thermal sensor 96 for location in another portion of a walkway at a pre-determined distance from cable 52. Sensor 96 is utilized to detect the temperature of a pavement or concrete walkway and provides information to the controller depicted in FIG. 12 as to when heating assembly 84 should be energized. FIG. 11 schematically illustrates cable 52 in that a neutral line is connected to resistive shell 58 and power is provided to central conductor 54. Termination end 78 allows the flow of power to be applied to resistive shell 58 to thereby dissipate heat therefrom.

Now, additionally referring to FIG. 12, there is shown a surface heating system 100 including controller 102, status indicators 104, FET 106 and switching system 108. Controller 102 includes analog and digital inputs as well as outputs. Specifically what is shown is three analog inputs that receive information from thermal sensor assembly 86, thermal sensor assembly 92 and adjustment 114. The temperature of cable 52 is detected by thermal sensor assembly 86 and is utilized by controller 102 to, in one embodiment of the present invention, prevent the overheating of cable 52. Information from thermal sensor 92 provides the information necessary to ensure that the walkway in which cable 52 is installed is at an appropriate temperature and to disengage the electrical power to cable 52 when the walkway is above a pre-determined temperature. A digital output from controller 102 drives FET 106 to turn on switching assembly 108. Switching assembly 108 is depicted as a relay, which is only illustrative in nature. Switching system 108 may be an optically isolated semiconductor switch capable of rapidly connecting and disconnecting an AC power source to heater assembly 84.

In one embodiment of the present invention, thermal sensor assembly 86 closely monitors the temperature of cable assembly 52 to prevent overheating of cable 52. For example, if cable 52 has a resistivity of one ohm per foot and the stock length of cable is 150 feet long the total resistance would be 150 ohms. If the desired maximum current is 1 amp and the supply voltage is 120 volts AC, unless the length of cable 52 is shortened to less than 120 feet, there is no limit on the current supplied to cable 52 since the resistance of 150 ohms would, by its electrical resistance, limit the current flowing through cable 52 to 0.8 amps. If cable 52 is shortened to 120 feet then again no limitation on the current would be needed where as the 120 volt power supply would supply exactly 1 amp to the 120 ohm, 120 foot long cable. It is when cable 52 is shortened, in this example, to less than 120 feet that current to cable 52 is limited.

In one embodiment of the present invention thermal sensor 86 detects the temperature of cable 52 which is conveyed to controller 102 and when a pre-determined temperature of cable 52 is arrived at controller 102 disconnects power to cable 52 thereby preserving the integrity of cable 52. Once cable 52 has cooled, power is restored to cable 52. The current is not limited to a predetermined current, as in the example above. But rather the controlling aspect is to monitor the temperature of cable 52 and apply power based only upon the temperature of cable 52 and the necessity for heat determined by the temperature detected in the walkway by thermal sensor assembly 92. There is a practical limit as to how short cable 52 can be cut, based upon the current capacity of the AC source. For example, if there is a circuit power limitation of 10 amps, then cable 52 will need to be at least long enough for cable 52 to have at least 12 ohms so that no more than 10 amps will be consumed. If cable 52 has a resistance of one ohm per foot then cable 52 would have to be 12 feet long to thereby provide a minimum of 12 ohms resistance so that the current supply capacity is not exceeded. Controller 102 engages and disengages power to cable 52 to limit the temperature of cable 52 by effectively limiting the average current applied to cable 52. Controller 102 is also known as an average current limiting device 102.

In yet still another embodiment of the present invention, the length of cable 52 is measured and the length is indicated on an adjustment device 114, which has an analogous length setting, which may be indicated in feet of meters. Adjustment device 114 is a potentiometer that is read by controller 102. The length setting of cable 52 is thereby manually supplied to controller 102. The information supplied to controller 102, by way of adjustment device 114, allows controller 102 to modulate the AC power source to cable 52 by way of switching system 108. By way of example, if cable 52 has a resistance of 1 ohm per foot and if a desired power output is 1 Watt per foot and the cable is cut to a length of 60 feet, then 60 feet is indicated on adjustment 114. Controller 102 switches the AC source power to cable 52 to thereby provide a predetermined portion of the AC waveform, based on the setting on adjustment 114, to provide a predetermined average current to cable 52. Switching system 108 may rapidly connect and disconnect the power source to and from cable 52 by turning the power on at a zero crossing of the AC waveform and then disconnecting cable 52 at a portion of the AC waveform, which corresponds to the desired average current, as in this case 1 amp.

In yet another embodiment of the present invention, the current supplied to cable 52 is a current that is limited by the detection of the current going into cable 52. The limiting of current to cable 52 may be by way of current limiter 116, which detects and limits the current therethrough by a switching mechanism separate from switching system 108 or controller 102. Current limiter 116 may be eliminated and controller 102 can control switching system 108 to perform the switching function to thereby reduce the number of parts involved in the assembly.

The switching of the power line may produce electromagnetic radiation that is undesirable. To counter this effect, the power line is switched and the resulting waveform may be converted into a lower voltage sine wave by passing it through a low pass filter.

The fundamental approach to the present invention is to keep the heater cable temperature regulated to prevent the destruction of heater cable 52. This is accomplished by controlling the average current supplied thereto, which in effect results in a heater that is effectively a constant temperature heater. Advantageously, the present invention provides a small diameter heater cable with a circular cross-sectional construct. Additionally, the present invention provides a constant wattage per unit length heater that is regulated even though the heating cable is cut to a desired length. Further, the heating cable of the present invention is self shielding in that the electrical current passes in opposite directions and effectively cancels radiated electromagnetic waves. Further, the supply voltage needs only to be connected to one end of the heater cable.

Although the present invention has been discussed as applying to the heating of walkways and paved areas, it is understood that the cable and the control technique may be used in many other applications. Some applications include the heating of ceramic tile floors, drum heaters, radiant heaters, pipe heaters and stock tank heaters. While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cut-to-length heating system, comprising:

a heating cable including a first conductor having a first resistivity and a second conductor having a second resistivity, said heating cable having a first end and a second end, said first resistivity substantially higher than said second resistivity; and an average power limiting device electrically connecting said first conductor and said second conductor at said second end, said first conductor being directly electrically connected to said second conductor at said first end.

2. The system of claim 1, wherein said average power limiting device supplies an average predetermined current to one of said first conductor and said second conductor.

3. The system of claim 1, wherein said heating cable is substantially surrounded by one of concrete and asphalt.

4. The system of claim 1, further comprising a temperature sensor one of intimately connected to said cable and embedded in said cable.

5. The system of claim 4, wherein said temperature sensor provides information to said average power limiting device, said power limiting device utilizing said information to turn off power to said heating cable if said information corresponds to a predetermined temperature.

6. The system of claim 1, wherein said first resistivity is over 10 times the resistivity of said second resistivity.

7. The system of claim 1, further comprising insulation substantially surrounding said second conductor, said first conductor substantially surrounding said insulation.

8. The system of claim 1, wherein said average power limiting device, limits electrical current entering said heater cable to a predetermined value.

9. The system of claim 1, further comprising a cable length setting device that provides information analogous to a length of said heater cable to said power limiting device, said power limiting device providing power to said heater cable dependent upon said information.

10. A tri-axial heating cable, comprising:

a center conductor having a conductivity characteristic;

an insulating layer substantially surrounding said center conductor;

a resistive conductor layer substantially surrounding said insulating layer, said resistive conductor layer having a resistance at least ten times the reciprocal of said conductivity;

an electrical insulating layer substantially surrounding said resistive conductor layer; and a conductive layer substantially surrounding said electrical insulating layer.

11. The cable of claim 10, wherein said resistive conductor layer is one of a mesh and a helically wound resistive conductor.

12. The cable of claim 10, wherein said center conductor and said resistive conductor are connected together proximate an end of said cable.

13. A method of controlling energy delivered to a heating system, comprising the steps of:

providing at least one heating cable;

selecting a predetermined heat density for said at least one heating cable;

determining a resistance value of at least one said heating cable; and delivering electrical current to said heating cable dependent on said resistance value and said predetermined heat density.

14. The method of claim 13, further comprising the steps of:

cutting said heating cable to a length, thereby forming a new end; and electrically connecting together at least two conductors at said new end.

15. The method of claim 13, further comprising the step of installing said heating cable proximate to one of a roof gutter and a roof.

16. The method of claim 13, further comprising the step of installing said heating cable embedded in one of concrete and pavement.

17. The method of claim 13, wherein said delivering electrical current step includes limiting an average current supplied to said heating cable to a predetermined value.

* * * * *